US006126893A

United States Patent [19]

Otsuka et al.

[11] Patent Number: 6,126,893

[45] Date of Patent: Oct. 3, 2000

[54] STAVE FOR COOLING OF BLAST FURNACE WALLS AND METHOD OF MANUFACTURING SAME

[75] Inventors: Hajime Otsuka; Atsushi Shiga; Hisao Ishii, all of Futtsu, Japan

[73] Assignee: Nippon Steel Corporation, Tokyo, Japan

[21] Appl. No.: 09/214,025

[22] PCT Filed: Jul. 9, 1997

[86] PCT No.: PCT/JP97/02381

§ 371 Date: Dec. 23, 1998

§ 102(e) Date: Dec. 23, 1998

[87] PCT Pub. No.: WO98/01584

PCT Pub. Date: Jan. 15, 1998

[30] Foreign Application Priority Data

| | | | |
|---|---|---|---|
| Jul. 9, 1996 | [JP] | Japan | 8-196977 |
| Sep. 12, 1996 | [JP] | Japan | 8-262347 |
| Jan. 14, 1997 | [JP] | Japan | 9-15994 |

[51] Int. Cl.[7] ..... C21B 7/10

[52] U.S. Cl. ..... 266/193; 266/190

[58] Field of Search ..... 266/190, 193, 266/194, 46

[56] References Cited

U.S. PATENT DOCUMENTS 4,382,585 5/1983 Fischer et al. ..... 266/193

FOREIGN PATENT DOCUMENTS

| | | |
|---|---|---|
| 51-147408 | 12/1976 | Japan . |
| 55-122810 | 9/1980 | Japan . |
| 59-157452 | 10/1984 | Japan . |
| 6-158131 | 6/1994 | Japan . |
| 6-234079 | 8/1994 | Japan . |

*Primary Examiner*—Scott Kastler
*Attorney, Agent, or Firm*—Kenyon & Kenyon

[57] ABSTRACT

In the structure of a stave for cooling carbon fire-bricks laid on a hearth side wall of a blast furnace, the stave arranged between the carbon fire-bricks on the hearth side wall and a shell is made of a rolled steel plate. The stave body is formed in such a manner that a cooling water passage is formed by drilling the steel plate directly, or the steel plate on which grooves are formed is joined onto another steel plate to be used as a cover. A cooling water feed port and a cooling water discharge port are provided on the outside of the stave body, and these ports are connected to the cooling water passage.

8 Claims, 10 Drawing Sheets

STAVE FOR COOLING OF BLAST FURNACE WALLS AND METHOD OF MANUFACTURING SAME

TECHNICAL FIELD

The present invention relates to a structure for cooling a blast furnace wall. More particularly, the present invention relates to a structure for cooling a hearth side wall, by which a high heat load section on the blast furnace wall can be intensely cooled so that the life of the blast furnace wall can be extended. Also, the present invention relates to a method of manufacturing a stave used in the cooling structure.

BACKGROUND ART

A blast furnace wall, in particular, the hearth side wall is the portion which determines the life of the blast furnace. Therefore, prevention of damage to carbon fire-bricks composing the hearth side wall is a most important item. The causes of damage to carbon fire-bricks laid on the hearth side wall are corrosion caused by molten iron and embrittlement caused by thermal stress. In order to prevent damage to carbon fire-bricks, it is most effective to intensely cool the high heat load section on the blast furnace wall.

In respect of the method of cooling the hearth side wall of the blast furnace, there are provided two methods. One is a method of cooling the hearth side wall by circulating water in staves, and the other is a method of cooling the hearth side wall by spraying water on a shell of the blast furnace.

In this case, explanations will be made of a structure of the hearth side wall equipped with common staves for cooling. As shown in FIG. 1, carbon fire-bricks 4 are layered on the inside of the blast furnace. Between the layer of carbon fire-bricks 4 and the shell 1, there are provided stamping refractories 3, staves 5 and castable refractories 2. On a bottom hearth portion T of the blast furnace, fire-bricks 12 are layered, and cooling pipes 13 are arranged on the bottom hearth portion T. Therefore, the hearth side wall R of the blast furnace is cooled by the staves 5, and at the same time, the bottom hearth portion T is cooled by the cooling pipes 13. Reference numeral 10 is a tap hole.

As the conventional staves 5, a stave 6 made of cast iron shown in FIGS. 2A and 2B is mainly used. This stave 6 is composed in such a manner that the stave pipes 7 having cooling water passages 15 are cast at predetermined intervals. In order to prevent the occurrence of carburizing caused in the process of casting and also in order to reduce a thermal shock, the stave pipe 7 is coated with marshite 8 which functions as a heat insulating layer. In the stave pipe 7, there are provided a water feed pipe 14*a* for feeding cooling water and a water discharge pipe 14*b* for discharging cooling water.

The hearth side wall of the blast furnace is cooled when cooling water flows in the stave pipe 7 and also when heat is radiated from the shell 1. However, a quantity of heat not less than 95% of the heat to be removed from the side wall is taken away by cooling water flowing in the stave pipe 7. Accordingly, in order to enhance the cooling capacity for cooling the hearth side wall, it is effective to reduce a heat resistance between the carbon fire-bricks 4 and cooling water in the stave 6.

For this reason, improvements have been made to enhance a coefficient of thermal conductivity (inverse number of heat resistance) between the carbon fire-bricks 4 and the stamping refractories 3. Therefore, the cooling capacity for cooling the hearth has been enhanced.

However, the heat resistance of marshite 8 coated on the surface of the stave pipe 7 in the stave 6 made of cast iron is very high. Therefore, this increase in the heat resistance of the stave 6 made of cast iron has been a problem to be solved.

In order to solve the above problems, Japanese Unexamined Patent Publication (Kokai) No. 6-158131 discloses a technique in which the cooling pipe is made to come directly into contact with the stamping refractories 3 or the carbon fire-bricks 4. According to this method, the thermal resistance of the stave 6 made of cast iron can be eliminated. Therefore, the heat resistance between the carbon fire-bricks 4 and the cooling water flowing in the cooling pipe can be reduced.

However, the following problems may be encountered in the above cooling system. The above cooling system is unlike the conventional stave cooling system in which the surface of the stave 6 made of cast iron is contacted with the surfaces of the carbon fire-brick 4 via the stamping refractories. Accordingly, in the above cooling system, when the carbon fire-bricks 4 are expanded in the operation of the blast furnace, due to a difference of thermal expansion between the carbon fire-bricks 4 and the shell 1, the cooling pipe is compressed, so that the cooling pipe or the carbon fire-bricks 4 are damaged, or alternatively a gap is caused between the cooling pipe and the carbon fire-bricks 4, so that the heat resistance is increased. As a result, the reliability of the installation is deteriorated.

In other words, as compared with the time at which the blast furnace was constructed, when the blast furnace is operated for production, a gap more than several tens of mm is caused between the carbon fire-bricks 4 and the shell 1. This difference of thermal expansion is absorbed by the contraction of the stamping refractories 3 in the conventional stave cooling system. However, according to the invention disclosed in Japanese Unexamined Patent Publication (Kokai) No. 6-158131, no consideration is given to this point, and there is such a problem as the cooling pipe and the carbon fire-bricks 4 are damaged and as the heat resistance is increased.

Japanese Unexamined Patent Publication (Kokai) No. 55-122810 discloses a technique, which will be described as follows. The stave body is composed of a plate made of copper or copper alloy, the heat conductivity of which is good. A plurality of holes are formed by drilling in the longitudinal direction of the plate, and the end openings are closed up. After that, connecting ports for connecting the cooling water pipes are formed on the back side of the plate. The above stave cooling system is adopted for a shaft portion of the blast furnace.

When the above stave is applied to the shaft portion of the blast furnace in which the fluctuation of a heat load caused by gas in the blast furnace is directly imposed on the stave, the efficiency is high because the cooling capacity of the stave is large and further no carburizing of copper is caused by the carbon contained in the blast furnace gas.

However, on the hearth side wall of the blast furnace, it is presupposed that the carbon fire-bricks 4 must remain inside the blast furnace. Accordingly, the stave is cooled via the front carbon fire-bricks 4 and the stamping refractories 3. Due to the heat resistance of these portions, even if the coefficient of thermal conductivity of the base metal of copper is high, the overall coefficient of thermal conductivity is not so high, that is, the cost is increased too much with respect to the improvement in the cooling capacity. In the structure of the stave disclosed in the above patent publication, it is necessary to provide a cooling water feed port and a cooling water discharge port for each cooling water passage in the longitudinal direction of the plate composing the stave. Accordingly, the number of pipe attaching sections to be connected with the cooling water feed port and the cooling water discharge port is increased. Therefore, the number of openings formed on the shell 1 is greatly increased in the case of installation of the stave. Accordingly, the above stave is disadvantageous in that the shell thickness is increased and the number of gas sealing portions to seal up the openings is increased.

SUMMARY OF THE INVENTION

It is an object of the present invention to provide an inexpensive and reliable structure for cooling a blast furnace side wall by enhancing the cooling capacity to cool a high heat load section. Also, it is an object of the present invention to provide a method of producing a stave used for the structure for cooling a blast furnace wall.

In order to solve the above problems, the present invention is to provide a structure for cooling a hearth side wall of a blast furnace characterized in that: a steel plate, for example, a rolled steel plate is machined, so that a cooling water passage is formed on the steel plate; a cooling water feed port and a cooling water discharge port, which are respectively connected to the cooling water passage, are provided on the steel plate; and the thus formed stave is arranged between carbon fire-bricks on the hearth side wall of the blast furnace and the shell.

Also, the present invention is to provide a stave in which a cooling water passage is formed by drilling a rolled steel plate.

Moreover, the present invention is to provide a stave characterized in that: a cooling passage is formed by means of machining on at least one of the surfaces of a rolled steel plate; and this rolled steel plate is joined to another rolled steel plate which has not been machined.

Furthermore, the present invention is to provide a method of producing a stave for cooling a blast furnace wall, comprising the steps of: forming a plurality of blind holes by drilling a rolled steel plate in the longitudinal direction; closing up end portions of the blind holes by plugs; forming blind holes on the rolled steel plate by drilling from the short sides at both end portions in the longitudinal direction of the rolled steel plate so that the blind holes can cross the blind holes in the longitudinal direction or alternatively the blind holes can penetrate the plugs; and closing up the end portions of the blind holes by plugs, so that a plurality of C-shaped cooling water passages can be formed in the rolled steel sheet.

Moreover, the present invention is to provide a method of producing a stave for cooling a blast furnace wall, comprising the steps of: drilling a plurality of through-holes from both end portions of a rolled sheet in the longitudinal direction; closing up both end portions by plugs; and forming connection passages for connecting the cooling water passages in the longitudinal direction with each other, at positions adjacent to closing portions of the ends of the cooling water passages in the longitudinal direction, so that a plurality of C-shaped cooling water passages can be formed in the rolled steel sheet.

Due to the stave structure of the present invention described above, it is possible to enhance the cooling efficiency of the stave and reduce the heat resistance. Further, it is possible to extend the life of a high heat load portion by a simple stave cooling structure.

BRIEF DESCRIPTION OF THE DRAWINGS

FIGS. 2A and 2B are partial enlarged views of FIG. 1 showing an example of a stave made of cast iron, wherein FIG. 2A is a partial cross-sectional view of the blast furnace wall, and FIG. 2B is an enlarged cross-sectional view of the cooling pipe.

FIGS. 4A, 4B, 4C and 4D are views showing an example of the stave of the present invention, wherein FIG. 4A is a front view, FIG. 4B is a cross sectional view taken on line C—C in FIG. 4A, FIG. 4C is a cross-sectional view taken on line B—B in FIG. 4A, and FIG. 4D is a cross-sectional view taken on line A—A in FIG. 4C.

FIGS. 5A, 5B, 5C and 5D are views showing another example of the stave of the present invention, wherein FIG. 5A is a front view, FIG. 5B is a cross sectional view taken on line C—C in FIG. 5A, FIG. 5C is a cross-sectional view taken on line B—B in FIG. 5A, and FIG. 5D is a cross-sectional view taken on line A—A in FIG. 5C.

BEST MODE FOR CARRYING OUT THE INVENTION

Figure 1:
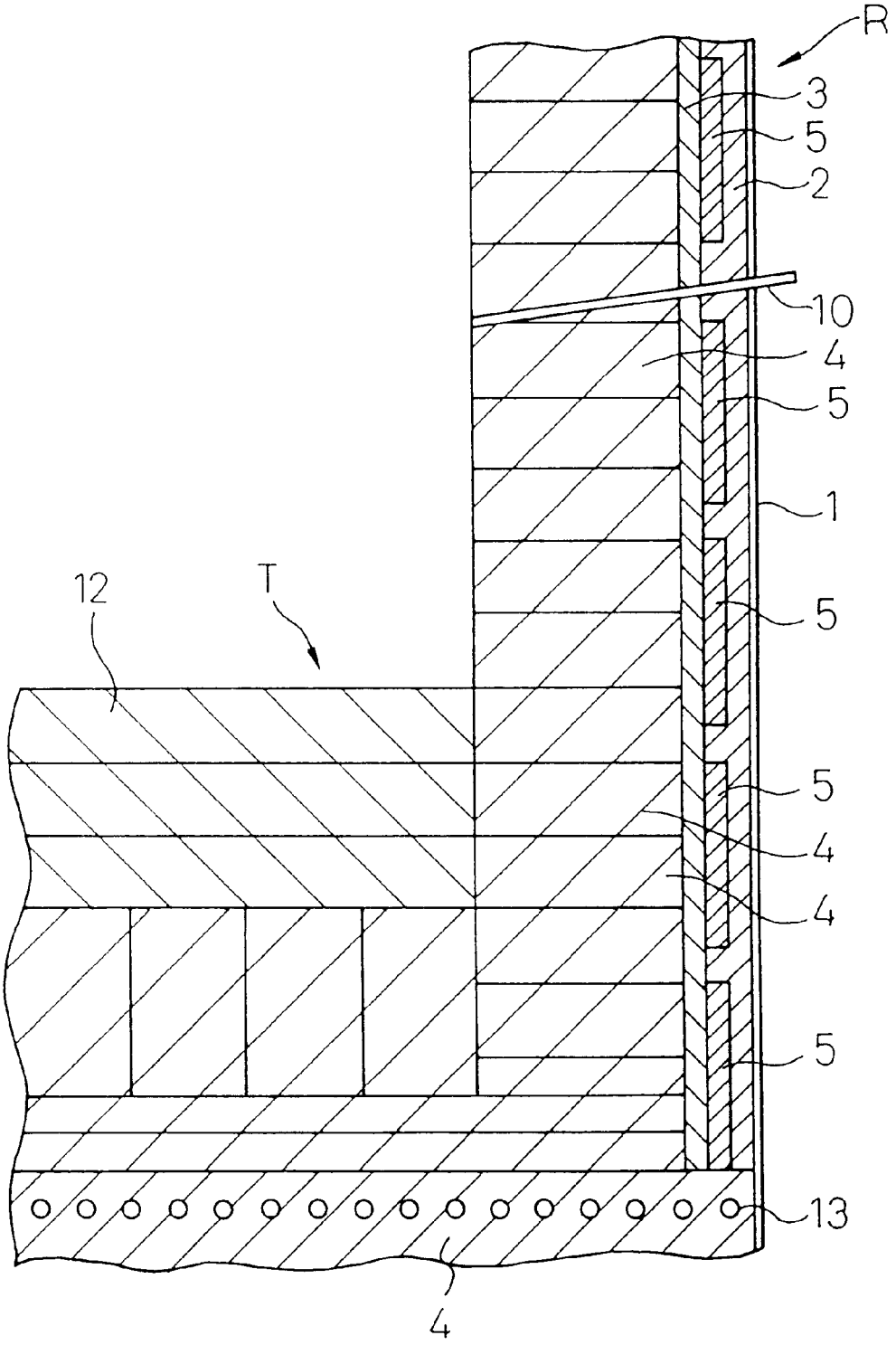
FIG. 1 is a partial longitudinal cross-sectional view of the hearth side wall of the conventional blast furnace.
Figure 2A:
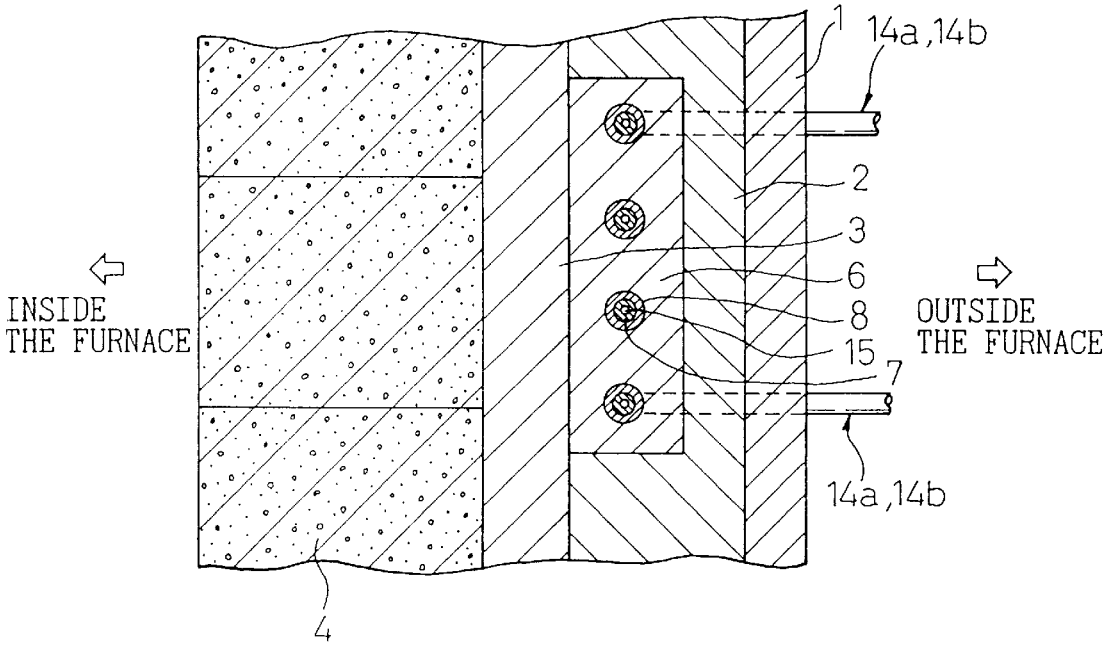
Figure 2B:
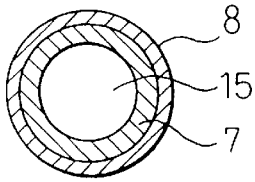
Figure 3:
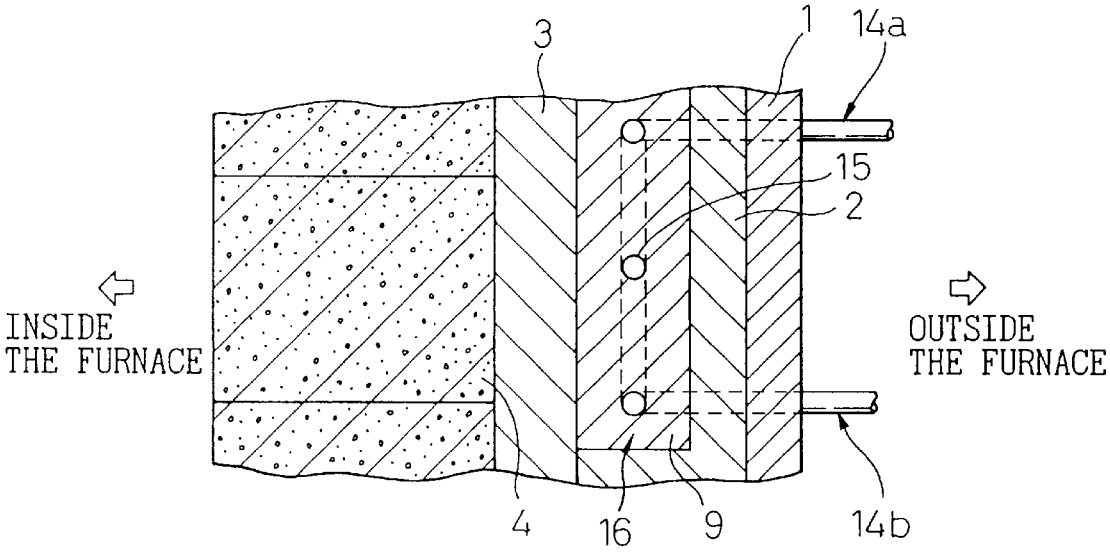
FIG. 3 is a partial longitudinal cross-sectional view of the hearth side wall on which the stave made of a steel plate of the present invention is arranged.

FIG. 3 is a view showing a state in which the stave 16 composed of a drilled steel plate, which is an example of the present invention, is incorporated onto the hearth side wall R.

Figure 4B:
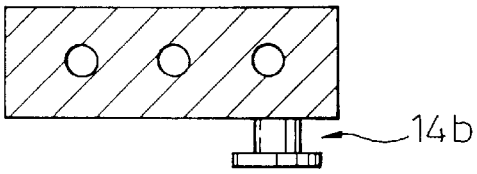
Figure 4C:
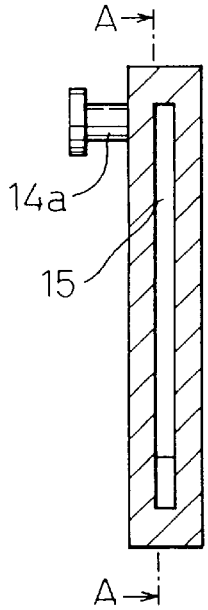
Figure 4A:
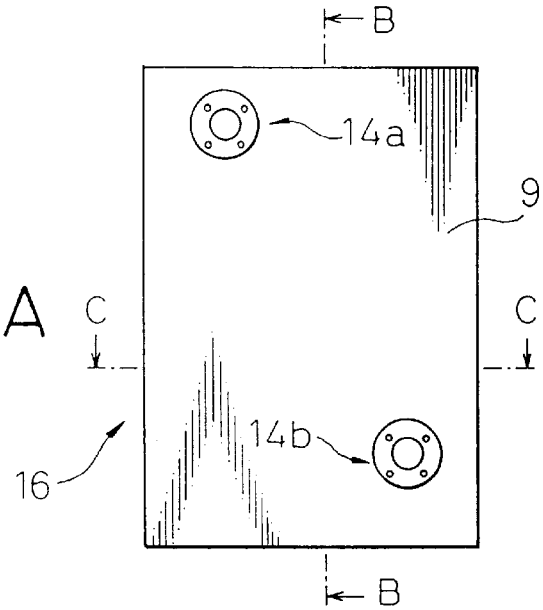
Figure 4D:
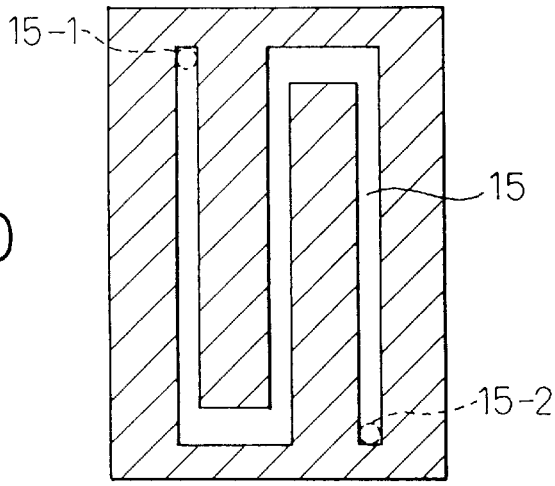

The stave 16 is composed as follows. The stave base metal 9 made of a steel plate is drilled. The thus formed hole is used as a cooling water passage 15. At both end portions of the cooling water passage 15, there are provided a cooling water feed pipe 14*a* and a cooling water discharge pipe 14*b*. These cooling water pipes 14*a*, 14*b* penetrate the shell 1 and the castable refractories 2, and connect with a water supply located outside the blast furnace. FIGS. 4A to 4D are views showing the stave in detail. FIG. 4A is a front view of the stave 16 made of a steel plate. The stave base metal 9 is rectangular. As shown in FIG. 4D, the cooling water passage is composed of three cooling water passages 15 which are combined to form C-shapes. This cooling water passage will be referred to as a water passage, hereinafter. The water feed pipe 14*a* and the water discharge pipe 14*b* are respectively connected with both end portions 15-1, 15-2 of the water passage.

The reason why the water passage is formed into a C-shape as described above is that each water passage is made independent so as to make a flow of water in the stave uniform and that the number of the openings on the shell is made small.

Figure 5B:
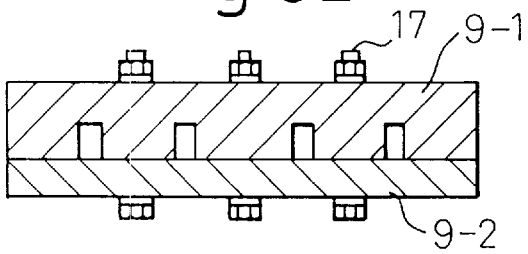
Figure 5C:
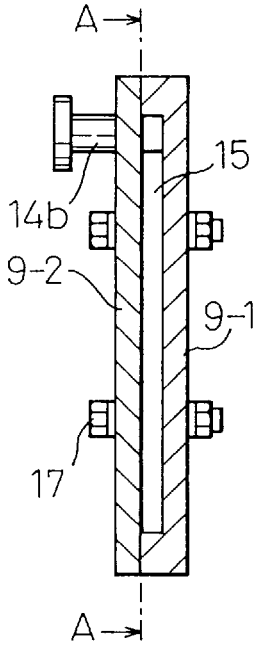
Figure 5A:
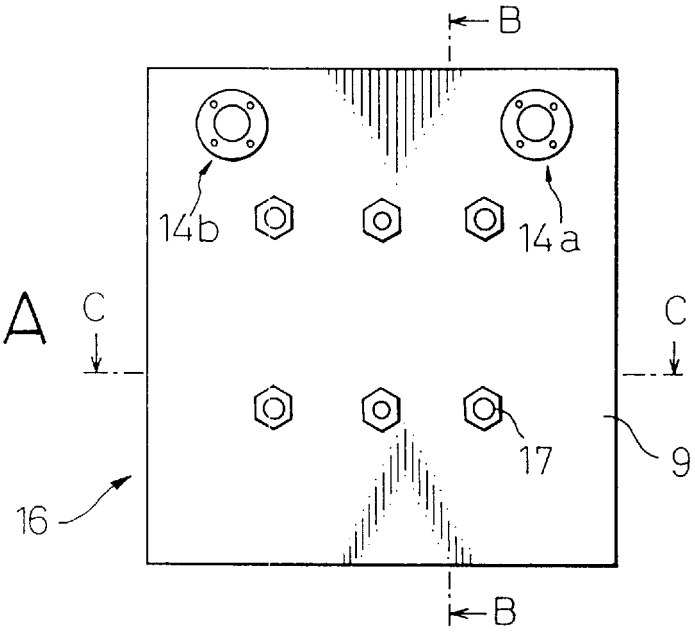
Figure 5D:
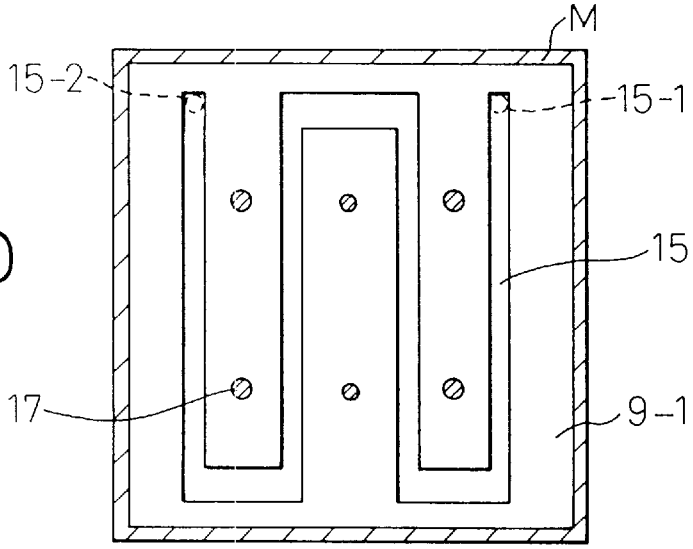

FIGS. 5A to 5D are views showing another example of the stave made of a steel plate of the present invention. As shown in FIGS. 5B and 5C, this stave 16 is composed as follows. The stave base metal 9 is divided into two members. On the surface of the thick steel plate 9-1, four grooves are formed by means of machining. These four grooves are used as water passages 15. On the surface of the thick steel plate on which the water passages 15 are formed by means of machining, the thin steel plate 9-2 is overlapped together. The entire circumference on which the two steel plates are joined to each other is subjected to welding all around (shown by reference character M in FIG. 5D), and further the centers of the two steel plates are fastened by bolts 17.

The thin steel plate 9-2 is drilled at positions corresponding to both end portions 15-1, 15-2 of the water passage 15, so that the water feed port and the water discharge port are provided at these drilled positions. The water feed pipe 14*a* and the water discharge pipe 14*b* are respectively inserted into these ports, and these water pipes are connected with the water passage 15.

In this type stave, it is possible to form a water passage arbitrarily. Therefore, it is possible to reduce the number of the water feed ports and the water discharge ports compared with the stave shown in FIG. 4. Accordingly, the number of the openings formed on the shell can be further reduced.

Next, referring to FIG. 6, a method of producing this steel plate drilling type stave will be explained below. In this example, there are four sets of C-shaped water passages in the stave.

First, in the upper portion of the stave base metal 9 in the longitudinal direction, two blind holes 15*a*, 15*a* are formed which extend from the left short side surface S, and also two blind holes 15*e*, 15*e* are formed which extend from the right short side surface S. Next, a blind hole 15*b* is formed which extends from the upper long side L of the stave base metal 9 to the blind end portions of the above blind holes 15*e*, 15*e*. This blind hole 15*b* is a hole to communicate the blind holes 15*e*, 15*e* with each other. Next, in the same manner as that described above, a blind hole 15*c* is formed which extends from the upper long side L of the stave base metal 9 to the blind end portions of the above blind holes 15*a*, 15*a*. This blind hole 15*c* is a hole to communicate the blind holes 15*a*, 15*a* with each other.

Next, the opening end portions of the blind holes 15*a*, 15*a* are closed up by the plugs 18*a*, 18*a* at the positions 15-1, 15-2 which are the water passage end portions. In order to insert the plug 18*b* into the blind hole 15*b*, the plugs 18*a*, 18*a* are drilled again. After that, the opening end portion of the blind hole 15*b* connecting the blind holes 15*e* is closed up by the plug 18*b*. In the same manner, the opening end portion of the blind hole 15*c* connecting the blind holes 15*a* is closed up by the plug 18*d*. The opening end portions of the blind holes 15*e*, 15*e* are closed up by the plugs 18*c* at the positions 15-1, 15-2 which are end portions of the water passage.

In the manner described above, two sets of C-shaped water passages 15, 15 are formed in the upper portion of the stave base metal 9.

In the same manner as that described above, two sets of C-shaped water passages 15, 15 are formed in the lower portion of the stave base metal 9.

In this connection, it is preferable that the plugs 18*a* to close up the blind holes formed first are tapered so that they can not be moved when the blind hole 15*b* is drilled.

A horizontal section of the bottom of the blast furnace is circular. Therefore, it is necessary that the rolled steel plate, on which the above C-shaped water passages are formed, is curved in accordance with the radius of curvature of the inner surface of the shell so that an interval between the stave and the shell can be maintained constant.

Figure 6:
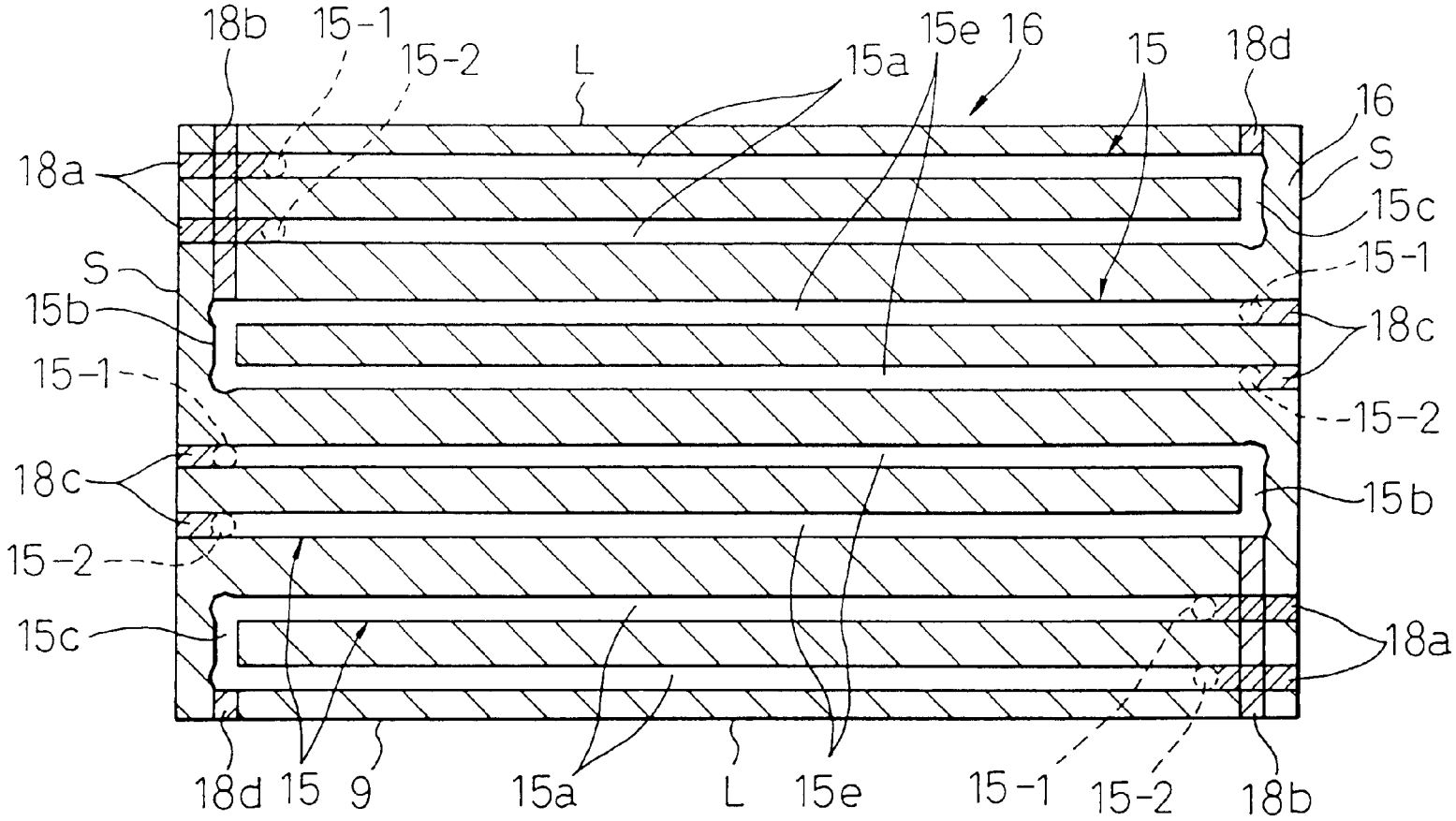
FIG. 6 is a horizontal cross-sectional view showing an example of the method of producing the stave structure shown in FIGS. 4A to 4D.
Figure 7A:
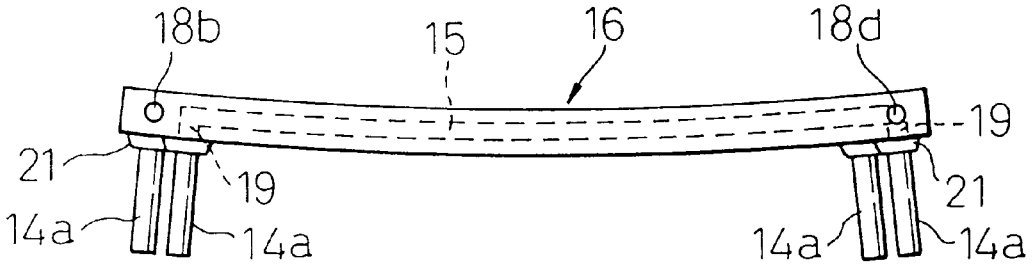
FIG. 7A is a plan view of the stave shown in FIG. 6.
Figure 7B:
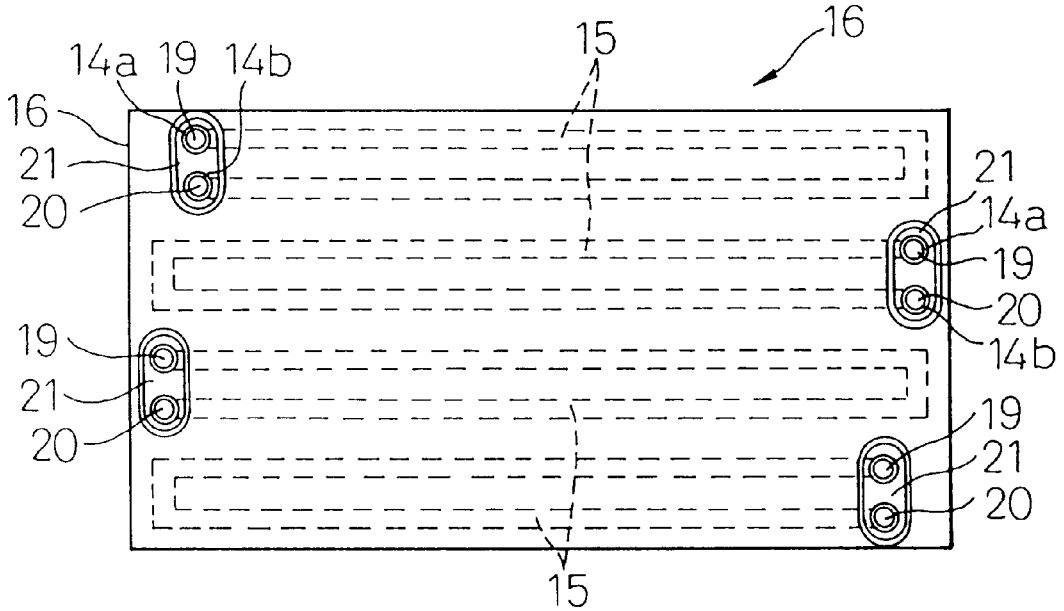
FIG. 7B is a front view of the stave shown in FIG. 6.

FIGS. 7A and 7B are views showing a stave having blind holes formed by the method explained in FIG. 6. At positions on the surface of the stave base metal corresponding to the blind hole end portions 15-1, 15-2, holes are formed by means of drilling in a direction perpendicular to the surface of the drawing, so that the water feed port 19 and the water discharge port 20 are respectively formed. After that, the stave body 16 is curved as shown by FIG. 7A in accordance with the radius of curvature of the inner surface of the shell. The water feed pipe 14*a* and the water discharge pipe 14*b* are arranged at the water feed port and the water discharge port via the water pipe mounts 21.

Figure 8:
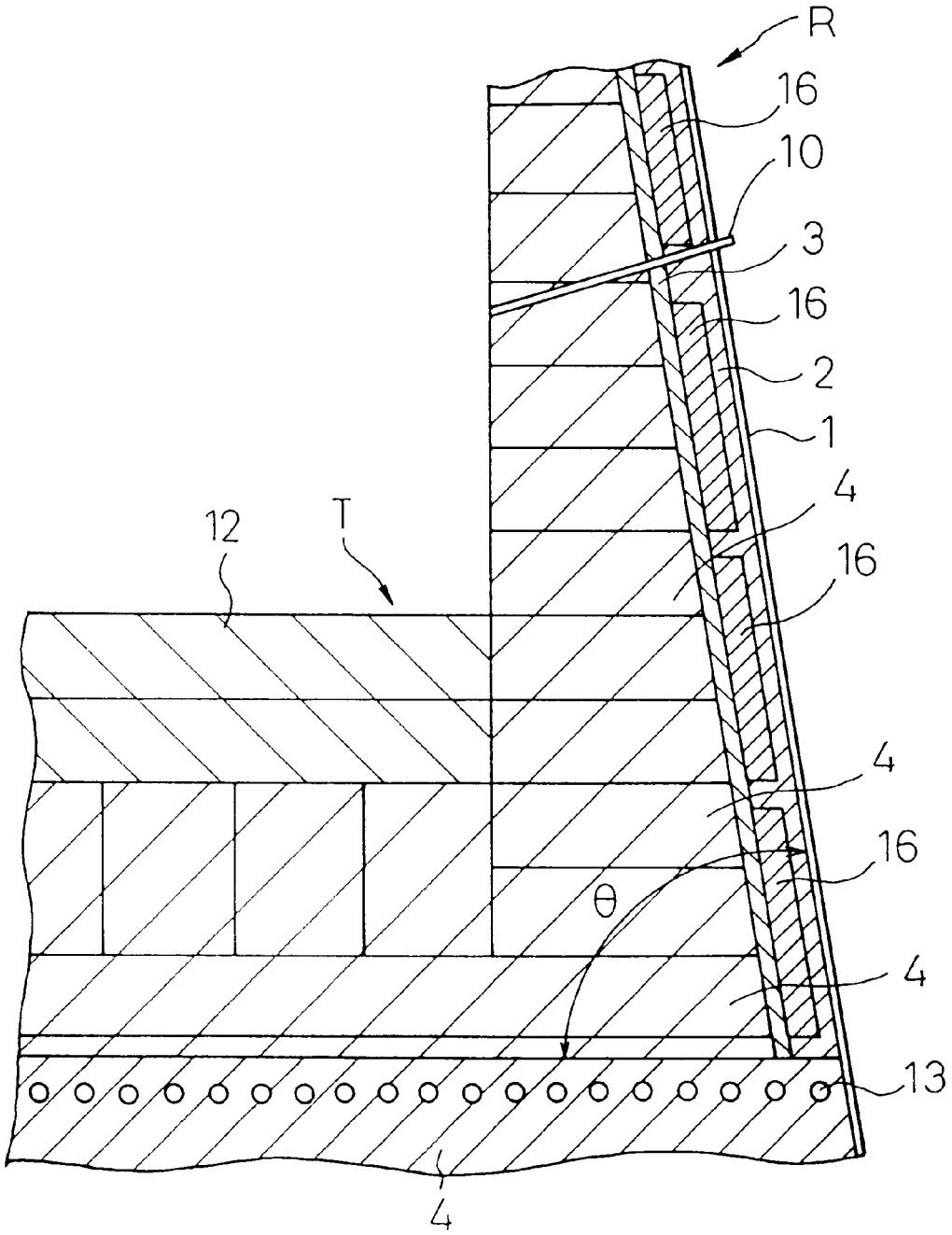
FIG. 8 is a longitudinal cross-sectional view showing a portion of the hearth side wall of the blast furnace composed of an inclined furnace wall.

As shown in FIG. 8, the hearth side wall of the blast furnace is inclined.

When the inclination angle θ of the furnace wall is approximately perpendicular, it is possible to apply the producing method shown in FIG. 6. However, when the inclination angle θ is small, the developed shape of the stave becomes a sector-shape. Accordingly, it is impossible to maintain the dimensional accuracy of the water passage in the longitudinal direction when the stave is produced by the producing method shown in FIG. 6.

Figure 9A:
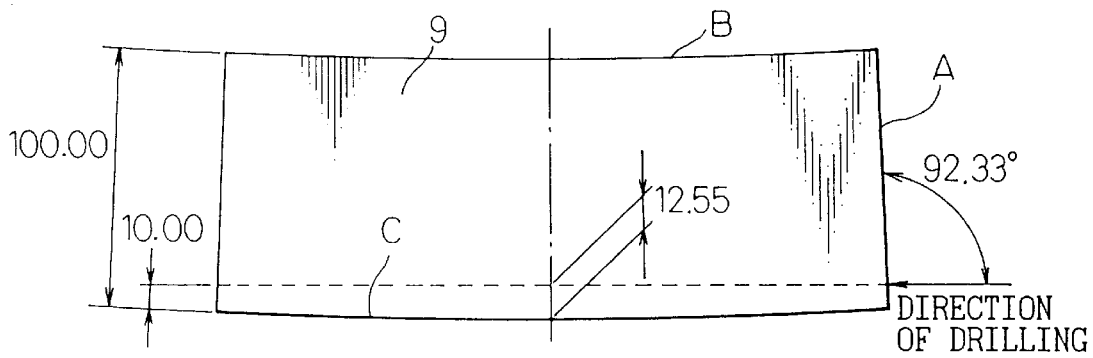
FIGS. 9A, 9B and 9C are views showing a method of forming a hole in the stave by drilling in the longitudinal direction of the stave used for the furnace wall illustrated in FIG. 8.
Figure 9B:
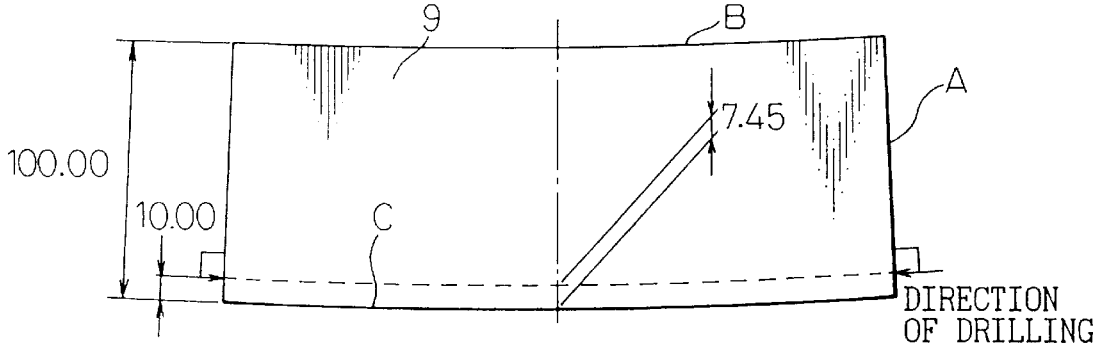
Figure 9C:
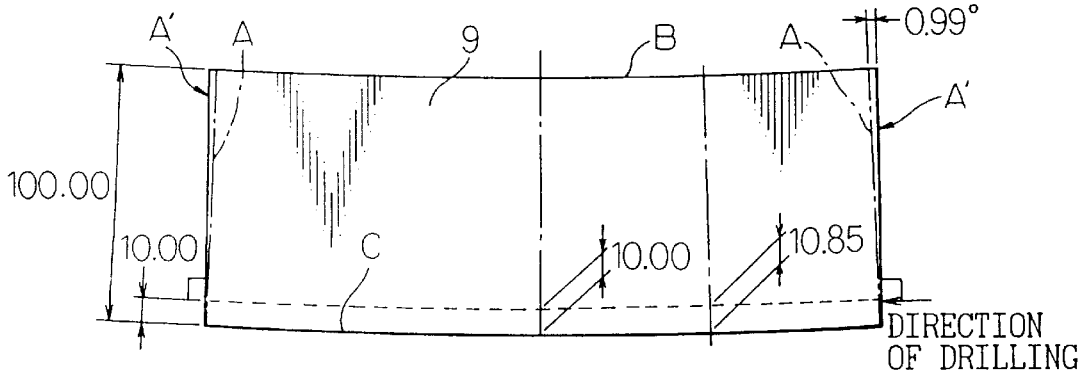

FIGS. 9A to 9C are views showing a comparison of the formation of the water passage in the longitudinal direction when different drilling methods are adopted in the case of the inclination angle θ=75°. In each view, there is shown a distance from the base C of the sector to the water passage in the longitudinal direction when the length of the side A is 100 cm and the water passage in the longitudinal direction is formed at a position distant of 10 cm from the lower end of the side A. Preferably, the distance from the base side C of the sector to the water passage in the longitudinal direction is constant at any position because it is possible to improve uniformity of cooling the stave due to constancy of the distance.

FIG. 9A is a view in which the water passage in the longitudinal direction is formed by the method illustrated in FIG. 6 and the blind holes are horizontally formed by means of drilling. According to this method, even if the drilling is conducted perfectly, a difference of the distance between the center of the sector and the peripheral portion of the sector is as large as (12.55−10)=2.55 cm. In this example, an angle formed between the drilling direction and the side A is 92.33°, which is not perpendicular to the side A. Therefore, it is difficult to set a drill tool to the intended direction. Accordingly, from the practical viewpoint, it is impossible to conduct drilling with high accuracy.

FIG. 9B is a view showing a method by which the above problems relating to accuracy of drilling direction can be solved when the stave is drilled. According to this method, drilling is conducted so that the drilling direction is perpendicular from both sides to the side A. In this case, a difference of the distance between the center of the sector and the peripheral portion of the sector is (7.45−10)=−2.55 cm. That is, the difference of the distance is substantially the same as that of the method shown in FIG. 9A. However, according to this method, a problem such as unstability of the drilling direction cannot be occurred.

FIG. 9C is a view showing a method by which a distance from the base C of the sector to the water passage in the longitudinal direction is minimized at each position when the water passage in the longitudinal direction is formed.

One point is determined on the side A in such a manner that a distance from the lower end of the side A to the point is 10 cm, and another point on the center line is determined in such a manner that a distance from the lower end of the center line to the point is 10 cm. A virtual line is drawn between these two points. Sides A', A' are determined so that the sides A', A' can become perpendicular to this virtual line. Then, the stave base metal is cut into a sector along the sides A', B, A' and C.

In the above stave base metal, the water passage in the longitudinal direction is formed in such a manner that the stave base metal is drilled from both end surfaces in a direction perpendicular to the sides A', A' and the thus formed holes are penetrated to each other at the center. After that, in order to remove redundant portions of the sides A', the stave base metal is cut again along the sides A, A. Then, both ends are closed up by plugs. According to this method, a difference of the distance between the base C of the sector and the water passage in the longitudinal direction is (10.85−10)=0.85 cm at the maximum. Therefore, the difference of the distance can be greatly improved by this method compared with the method explained in FIG. 9B.

The above explanations have been made when the inclination angle θ is 75°. Of course, when the inclination angle θ is larger than 75°, the stave base metal may be drilled by the method shown in FIG. 9(A) or 9(B).

Figure 10:
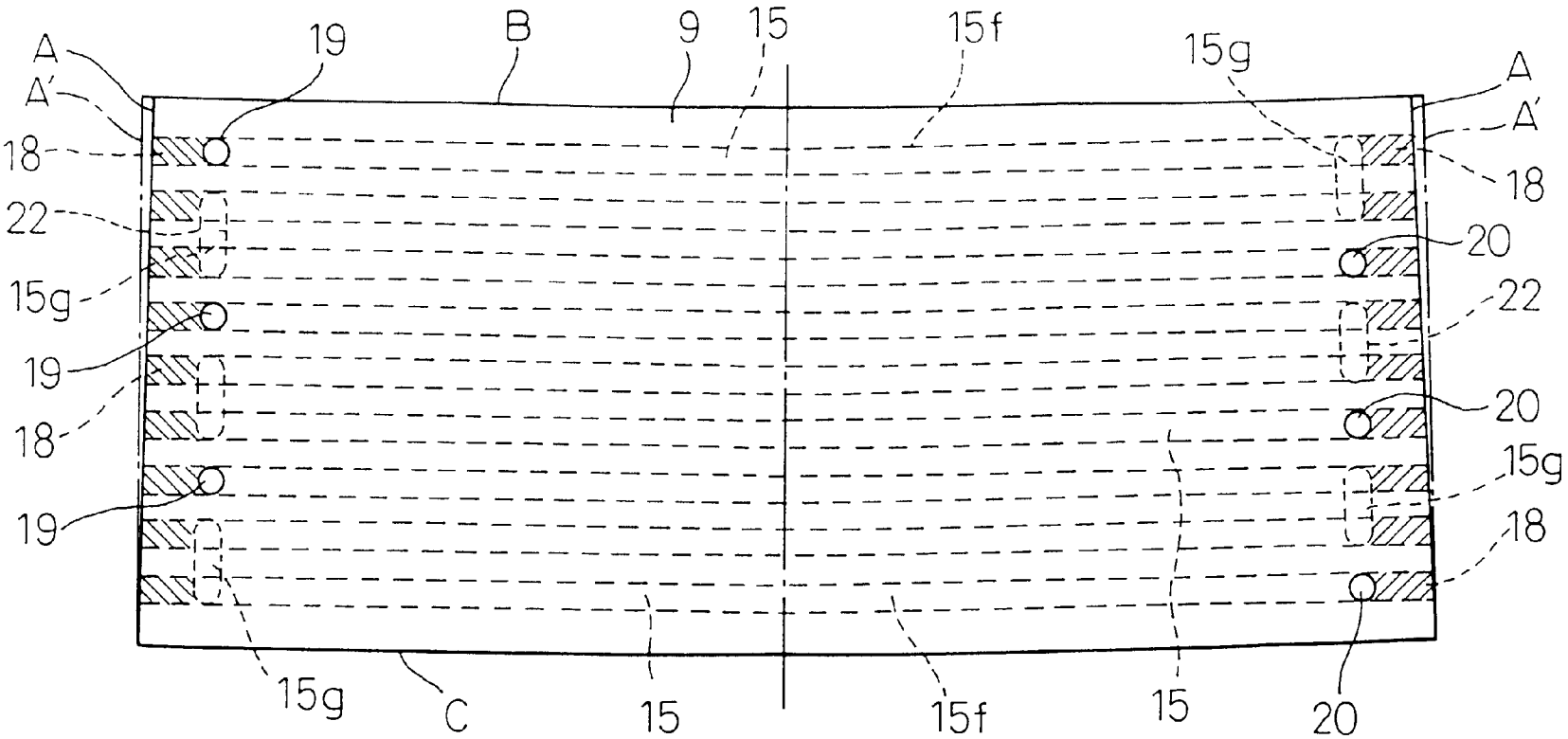
FIG. 10 is a front view of the stave formed by drilling according to the method illustrated in FIG. 9C.

Next, a specific example is shown in FIG. 10, in which a stave made of a steel plate used for a blast furnace, the inclination angle of which is θ=75°, is manufactured by the method shown in FIG. 9C.

First, the stave base metal 9 is cut out into a sector along the sides A', A', B and C shown in FIG. 9C. Then, the stave base metal is drilled from the sides A', A' in directions perpendicular to the sides A', A' by the drilling method shown in FIG. 9C. The thus formed holes penetrate each other at the center, so that the through-hole 15*f* in the longitudinal direction can be formed. This drilling method is adopted to the overall stave base metal, and nine through-holes in the longitudinal direction are formed.

Then, the stave base metal is cut out along the sides A, A, so that the stave base metal of the predetermined dimensions can be obtained. All openings on both end portions of the through-holes 15*f* in the longitudinal direction are closed up by the plugs 18.

Next, a connecting groove 15*g* to connect the two through-holes 15*f*, 15*f* in the longitudinal direction is formed at a position close to the through-hole closing section by means of cutting conducted on the surface of the stave base metal 9. After that, an opening section on the surface, which has been made by cutting, is closed by a cover 22.

In this way, three through-holes in the longitudinal direction are connected with each other, and one set of C-shaped water passage 15 can be composed. In the view, three sets of C-shaped water passages 15 are shown.

Then, in the same manner as that shown in FIGS. 7A and 7B, the stave base metal is drilled to form the water feed port 19 and the water discharge port 20; the stave body is curved in accordance with the radius of curvature of the inner surface of the shell; the water feed pipe and the water discharge pipe 14 are attached; and the water feed pipe mount and the water discharge pipe mount 21 are attached. In this way, the stave can be produced.

Due to the foregoing, in the same manner as that of a blast furnace having a perpendicular wall, even in the case of a blast furnace having an inclined wall, it is possible to produce an inexpensive and reliable stave by which the cooling capacity can be enhanced to cool a high heat load section of the blast furnace.

As described above, in the stave made of a rolled steel plate of the present invention, the cooling water passage is directly formed on the rolled steel plate by means of machining. Therefore, it is unnecessary to provide a marshallite layer, the heat resistance of which is high. Further, the cooling water passage can be formed with high accuracy by machining. Accordingly, the pipes are not moved in the process of casting, so that intervals of the cooling water passages can be shortened and thickness of the stave base metal can be reduced. As a result, the heat resistance of the overall stave can be decreased. In the method of the present invention, machining is conducted on a rolled steel plate, the cost of which is low, and it is unnecessary to conduct processing on pipes and it is also unnecessary to conduct casting. Accordingly, the producing cost is lower than that of the conventional stave.

EXAMPLE

Under the condition that the thickness of the residual carbon fire-bricks 4 was 0.5 m, the cooling capacity was 31138 kcal/m$^2$·h in the case of the conventional stave 5 made of cast iron in which the thickness of the stave was 160 mm and the pipe interval was 138 mm. On the other hand, in the case of the stave 16 made of a rolled steel plate of the present invention shown in FIGS. 4A to 4D, the dimensions of which were the same as those described above, it was possible to obtain a cooling capacity of 33038 kcal/m$^2$·h, that is, it was possible to enhance the cooling capacity by about 6%. Since the machining accuracy of the stave made of a rolled steel plate was high, it was possible to reduce the thickness of the stave and shorten the interval of the cooling water passages 15. When the stave thickness was changed to 100 mm and the interval of the cooling water passages 15 was changed to 100 mm, the cooling capacity was increased to 33851 kcal/m$^2$·h, that is, the cooling capacity was enhanced by about 10% compared with the cooling capacity of the cooling structure of the conventional stave made of cast iron.

INDUSTRIAL APPLICABILITY

As described above, when the stave made of a steel plate according to the present invention is used, the following effects can be provided. When the cooling water passage is formed into a C-shape on the steel plate, the number of the water feed ports and the water discharge ports and the number of the openings on the shell can be reduced to a half or less of those of the conventional stave. Further, the stave of the present invention can be produced by conducting an inexpensive rolled steel plate to machining and bending. Unlike the conventional stave made of cast iron, it is unnecessary to conduct processing of producing pipes and casting. Therefore, the producing cost of the stave of the present invention is lower than that of the conventional stave made of cast iron.

The thermal expansion of carbon fire-bricks caused in the process of operation is absorbed by the stamping refractories, and a generated force is not concentrated at a specific portion since it is received by the overall surface of the stave. Accordingly, the cooling water passages and the carbon fire-bricks are not damaged. Therefore, from the viewpoint of strength property, it is possible to provide the same reliability as that of the conventional hearth side wall structure.

The dimensions of one stave of the present invention are substantially the same as those of the conventional stave made of cast iron. Therefore, when the stave is attached onto the shell in the process of construction, an amount of work load is not increased, so that an increase in the construction cost can be prevented.

As described above, the stave of the present invention can provide a higher effect than that of the conventional stave. Consequently, industrial applicability of the stave of the present invention is very high.

What is claimed is:

1. A stave for cooling a blast furnace wall, the stave comprising a rectangular steel plate having a plurality of longitudinally-directed cooling water passages formed therein by machining; a plurality of connecting cooling water passages formed in said rectangular steel plate by machining communicating between ends of the longitudinally-directed passages to form a plurality of interconnecting C-shaped cooling water passages comprising at least a first and a last interconnecting C-shaped cooling water passage; and a cooling water feed port located at an inlet of the first C-shaped cooling water passage; and a cooling water discharge port located at an outlet of the last C-shaped cooling water passage.

2. A stave according to claim 1, in which the longitudinally-directed cooling water passages and the connecting cooling water passages are formed in the steel plate by drilling, with open ends of the cooling water passages being closed with plugs.

3. A stave according to claim 1, comprising:

a first steel plate, in the surface of which grooves are formed; and a second steel plate joined to the first steel plate, wherein the steel plates are fixed to each other, and the grooves of the first steel plate and the joining surface of the second steel plate define the longitudinally-directed and connecting cooling water passages.

4. A stave for cooling a blast furnace wall according to any of claims 1 to 3, wherein the stave is arranged in the blast furnace wall between carbon fire-bricks layered on a hearth side of the blast furnace wall and a shell of the blast furnace wall.

5. A method of producing a stave for cooling a blast furnace wall and having a plurality of interconnecting C-shaped cooling water passages in a steel plate, comprising the steps of:

drilling a rectangular steel plate in the longitudinal direction from both end portions so as to form a plurality of blind holes;

closing end opening portions of the blind holes with plugs;

drilling the steel plate in a direction perpendicular to the longitudinal direction at each end portion of the steel plate so as to form holes which communicate between the blind end of the longitudinal direction holes with perpendicular penetration of plugs previously inserted in the opening portions of the blind holes;

closing open end portions of the perpendicular holes with plugs;

thereby forming said plurality of interconnecting C-shaped cooling water passages in said steel plate comprising at least a first and a last interconnecting C-shaped cooling water passage;

disposing a cooling water feed port at an inlet of the first C-shaped cooling water passage; and disposing a cooling water discharge port at an outlet of the last C-shaped cooling water passage.

6. A method of producing a stave for cooling a blast furnace wall and having a plurality of interconnecting C-shaped cooling water passages in a steel plate, comprising the steps of:

forming grooves by machining in a surface of a first steel plate, the grooves having the configuration and dimensions required for the interconnecting C-shaped cooling water passages; and joining a second steel plate to said surface of the first steel plate whereby the grooves of the first steel plate and the joining surface of the second steel plate define the interconnecting C-shaped cooling water passages.

7. A method of producing a stave for cooling a blast furnace wall by having a plurality of interconnected C-shaped cooling water passages in a steel plate, comprising the steps of:

drilling a rectangular steel plate in the longitudinal direction from both end portions so as to form a plurality of through-holes;

closing both end opening portions of the through-holes with plugs;

grooving a surface of the steel plate at positions close to both end portions of the through-holes so as to form connecting holes for connecting the through-holes with each other; and covering upper surfaces of the connecting holes with a cover.

8. A method of producing a stave according to claim 7, for attachment to a blast furnace wall inclined with respect to the blast furnace bottom portion, comprising the steps of:

drawing a virtual line from each side of the steel plate so that the distance from the lower end of the side of the steel plate to the line is the same as the distance from the lower end of the center of the steel plate to the line; determining sides of the plate perpendicular to each virtual line; cutting the sector-shaped steel plate along the sides as determined;

drilling the steel plate from both sides in directions perpendicular to the sides, wherein the thus formed holes penetrate each other at the center so as to form longitudinal direction cooling water passages;

grooving the surface to form connecting holes and covering upper surfaces thereof with a cover, and cutting the sides of the sector-shaped steel plate so that plates of selected dimensions are obtained in which the sides of adjacent plates in use coincide with each other.

* * * * *